United States Patent [19]

Rogers

[11] Patent Number: 4,911,675

[45] Date of Patent: Mar. 27, 1990

[54] HOOP AND GUIDE DEVICE

[76] Inventor: M. Maurice Rogers, Rte. 1 Box 214, Downsville, La. 71234

[21] Appl. No.: 350,898

[22] Filed: May 12, 1989

[51] Int. Cl.[4] ..... A63H 33/02

[52] U.S. Cl. ..... 446/267; 446/438; 446/450; 446/485

[58] Field of Search ..... 446/438, 450, 453, 485, 446/242, 267, 411–413, 451, 452, 236

[56] References Cited

U.S. PATENT DOCUMENTS

| | | | |
|---|---|---|---|
| 1,909,718 | 5/1933 | Portteus | 446/450 |
| 3,123,937 | 3/1964 | Pace | 446/450 |
| 3,605,333 | 9/1971 | Copeland | 446/453 |
| 4,043,076 | 8/1977 | Potrzuski et al. | 446/438 |
| 4,304,067 | 12/1981 | Petrosky | 446/450 |

FOREIGN PATENT DOCUMENTS

| | | | |
|---|---|---|---|
| 17316 | of 1889 | United Kingdom | 446/438 |

*Primary Examiner*—Mickey Yu

*Attorney, Agent, or Firm*—John M. Harrison

[57] ABSTRACT

A hoop and guide device which is characterized by a round hoop provided with an optional light housing mounted therein and a telescoping guide designed for propelling the hoop. In a preferred embodiment of the invention, the guide telescopes in order to adjust the length thereof and is provided with a light at the upper end and a bevelled contact plate at the lower end. Furthermore, the hoop includes a hollow rim cavity designed to receive water and stabilize the hoop while it is propelled by the contact end of the guide. In another preferred embodiment of the invention, a circular housing ring is built into the light housing and includes a ball race for receiving a metal ball, and electrical contacts connected to a battery located in the light housing extend into the ball race in spaced relationship for periodically illuminating a light located in the battery housing as the ball traverses the ball race and bridges the contacts.

14 Claims, 2 Drawing Sheets

ON

HOOP AND GUIDE DEVICE

BACKGROUND OF THE INVENTION

Field of the Invention

This invention relates to hoop and stick toys and more particularly, to a toy or physical fitness apparatus which includes a round hoop and a guide device designed to propel the hoop. In a preferred embodiment, the hoop and guide device of this invention includes a round hoop having a hollow rim cavity fitted with spaced baffles for receiving water and stabilizing the hoop as it is propelled by an elongated, telescoping guide device fitted with a light at the handle end and a contact plate at the opposite end for contacting the hoop rim. In a most preferred embodiment of the invention, the hoop further includes a removable light housing fitted with a light and batteries for illuminating the light, as well as a ball race, a metal ball traversing the ball race and pair of contacts extending into the ball race for periodically receiving the ball, completing the circuit between the batteries and the light and causing the light to illuminate. In another preferred embodiment of the invention the light housing is removably fitted to the hoop rim by a pair of arms and split rings and both the hoop and guide are constructed of a plastic material to facilitate ease of construction.

Perhaps one of the oldest known toys since the origin of the wheel is the hoop and stick, which was, and to some extent still is, commonly used by children of all ages. The hoop element of the hoop and stick combination is typically constructed of a circular metal band or ring and is propelled by an elongated stick by a person running behind the ring. Not only does propulsion of the hoop in a straight or curved path over both rough and smooth terrain require skill in manipulation of the stick to strike the hoop, but the game also provides considerable exercise to the user, as the user must run in order to maintain a desired hoop speed. Accordingly, the hoop and stick provides an excellent exercise device which develops good hand-to-eye coordination and offers hours of entertainment for the user.

It is an object of this invention to provide a new and improved, safe, attractive, and exciting hoop and guide device having improved maneuverability, which device is characterized by a round hoop and an elongated guide having a handle at one end and a flat hoop contact plate at the opposite end for engaging and propelling the hoop.

Another object of the invention is to provide a hoop and guide device which includes a round hoop of selected diameter, an optional light housing removably mounted in the hoop and an elongated, adjustably telescoping guide having a grip or handle at one end and a flat contact plate at the opposite end for handling by the user and engaging and propelling the hoop.

Still another object of this invention is to provide a hoop and guide device, both elements of which are constructed of plastic, which hoop includes a hollow cavity and baffles for receiving water, in order to stabilize the hoop in rolling configuration. The guide is characterized by a pair of elongated telescoping members shaped to define a handle at one end and a bevelled contact plate provided at the opposite end for engaging the hoop rim and propelling the hoop.

Still another object of the invention is to provide a new and improved hoop and cooperating guide device for propelling the hoop, which hoop includes a plastic rim and a rim sleeve having a baffled, hollow interior for receiving water or an alternative liquid and stabilizing the hoop, as well as an optional light housing located inside the hoop, which light housing is fitted with a tubular ball race and a metal ball for periodically completing an electrical circuit in the light housing and illuminating a bulb therein.

Yet another object of this invention is to provide a hoop and a telescoping guide device for propelling the hoop, which hoop includes a plastic rim and a transparent, hollow rim sleeve attached to the rim and provided with internal baffles for receiving a supply of tinted liquid and/or multicolored flakes for ornamental effect as the hoop is propelled by the guide device.

SUMMARY OF THE INVENTION

These and other objects of the invention are provided in a hoop and guide device which includes a round hoop of selected diameter, at least a portion of the rim of which hoop may be transparent and is provided with a hollow interior having spaced baffles for receiving water or other fluid or liquid of selected color and viscosity, in order to stabilize the hoop while the hoop is rolling. An elongated, adjustably telescoping, light-equipped guide device is fitted with a handle at one end and a flat, bevelled contact plate at the opposite end for engaging and propelling the hoop. In a preferred embodiment, a light housing is removably mounted inside the rim of the hoop and is provided with a tubular ball race, a pair of electrical contacts spaced in the ball race, at least one battery and a bulb connected to the contacts, and a metal ball is located in the ball race for traversing the ball race and periodically bridging the gap between the contacts and causing the light to illuminate.

BRIEF DESCRIPTION OF THE DRAWINGS

The invention will be better understood by reference to the accompanying drawings, wherein.

DESCRIPTION OF THE PREFERRED EMBODIMENTS

Figures 1, 2, 3, 4, 5, 6, 7:
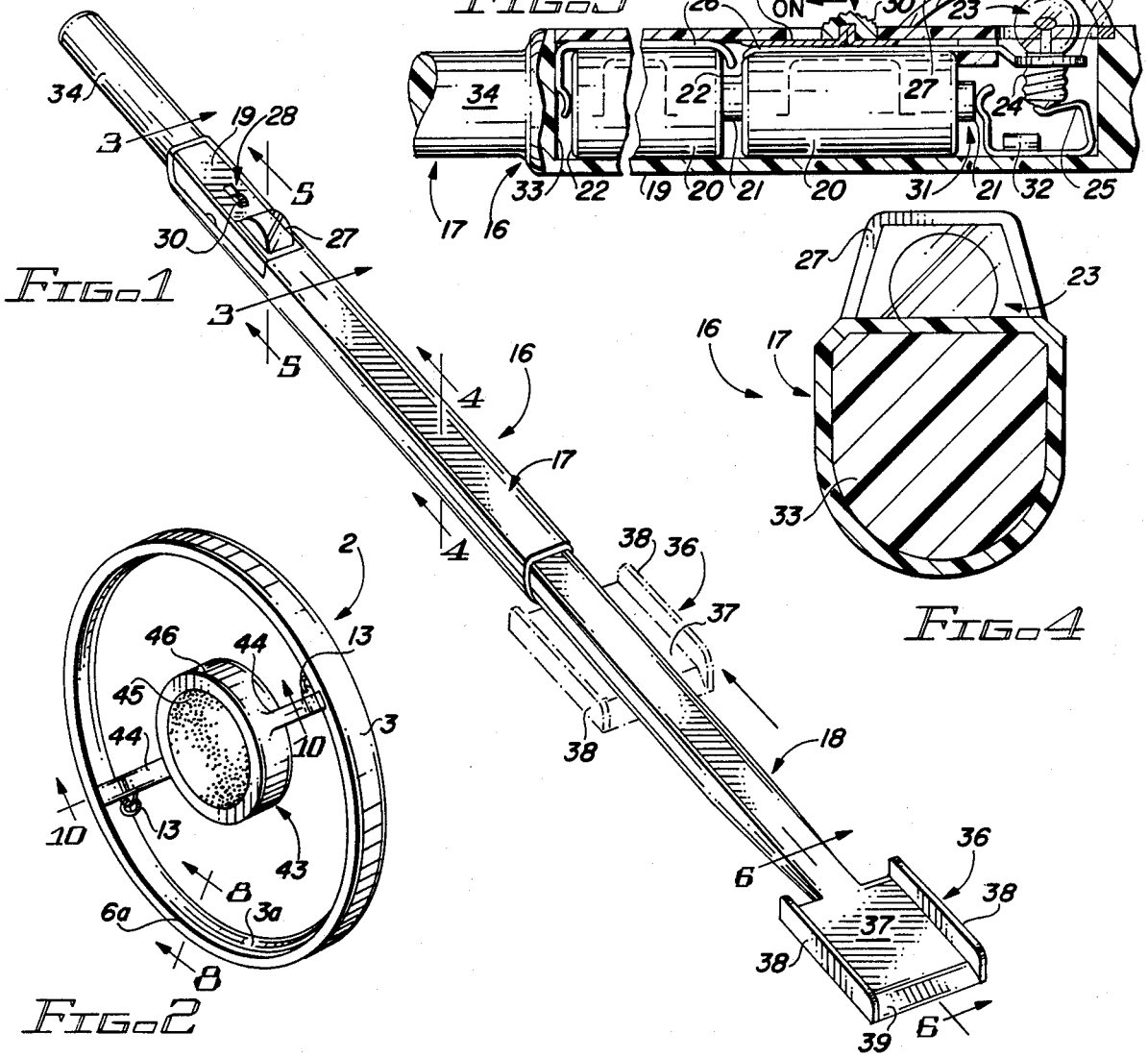
FIG. 1 is a perspective view of a preferred guide element of the hoop and guide device of this invention.
FIG. 2 is a perspective view of a preferred hoop element of the hoop and guide device.
FIG. 3 is a longitudinal sectional view taken along line 3—3 of the grip and light housing segment of the guide illustrated in FIG. 1.
FIG. 4 is a transverse sectional view taken along line 4—4 of the receiving handle segment of the guide illustrated in FIG. 1.
FIG. 5 is a transverse sectional view taken along line 5—5 of the light housing segment of the guide illustrated in FIGS. 1 and 3.
FIG. 6 is a longitudinal sectional view taken along line 6—6 of the contact end of the telescoping handle segment of the guide illustrated in FIG. 1.
FIG. 7 is a transverse sectional view of the telescoping segments of the guide illustrated in FIG. 1, more particularly illustrating a preferred means for adjusting one telescoping segment with respect to the other.

Referring initially to FIGS. 1 and 2 of the drawings, the hoop and guide device of this invention is generally illustrated by reference numeral 1, the hoop element thereof is designated by reference numeral 2 and the corresponding guide element is identified by reference numeral 16. The hoop 2 includes a round hoop rim 3 of selected diameter and a rim sleeve 3*a* extending inwardly from the hoop rim 3, while an optional light housing 43 is removably secured to the rim sleeve 3*a* by means of oppositely-disposed, spoke-like housing mount arms 44, as illustrated in FIG. 2. The light housing 43 includes a housing ring 46 attached to the two housing mount arms 44 and a pair of housing reflectors 45 close each side of the light housing 43, respectively.

As further illustrated in FIGS. 1 and 7, the elongated guide 16 is characterized by a receiving handle 17 and a cooperating telescoping handle 18, which is slidably mounted in the receiving handle 17. A battery housing 19 is provided in the opposite end of the receiving handle 17 from the point of entry of the telescoping handle 18 and a grip 34 extends from the battery housing 19 for handling the guide 16. The contact end 36 of the telescoping handle 18 is characterized by a flat contact plate 37, fitted with upward-standing, parallel, spaced side flanges 38 and having a plate bevel 39 for contacting the hoop rim 3 of the hoop 2 and propelling the hoop 2 along the ground or alternative surface. As illustrated in FIGS. 1 and 7, in a most preferred embodiment of the invention the telescoping handle 18 is further provided with at least two spaced protrusions or detents 40, which are designed to selectively register with corresponding spaced detent openings 41 located in the receiving handle 17, in order to telescopically adjust the telescoping handle 18 inside the receiving handle 17, as illustrated in phantom in FIG. 1. This adjustment compensates for the height and arm length of various users of the hoop and guide device 1 and under circumstances where the adjustment is made as illustrated in phantom in FIG. 1, the telescoping end of the telescoping handle 18 may be cut off, to prevent engagement with the battery housing 19.

Referring now to FIGS. 1 and 3–5 of the drawings, in a most preferred embodiment of the invention the battery housing 19 of the receiving handle 17 is characterized by a handle bulb 23, having a base 24 which is recessed in a battery receptacle 31 located inside the battery housing 19, against one end of a bulb positive lead 25, mounted on a bulb positive lead mount 32, provided in the battery housing 19. The opposite end of the bulb positive lead 25 rests against the positive terminal 21 of a first battery 20, a second battery 20 of which is also located in the battery housing 19, with the positive terminal 21 thereof seated against the negative terminal 22 of the first battery 20. A bulb negative lead 26 extends from the bulb flange 23*a* of the bulb 23, into contact with the negative terminals 22 of the batteries 20, respectively. The bulb negative lead 26 is separated into two aligned segments and both segments are located adjacent to the sliding switch plate 29 of a switch 28. The switch 28 further includes a thumb contact 30 for selectively manipulating the sliding switch plate 29 into contact with both segments of the bulb negative lead 26, to complete the electric circuit and facilitate illumination of the handle bulb 23. A handle reflector 27 is seated on the battery housing 19 over the handle bulb 23 and when the switch 28 is manipulated to complete the circuit in the battery housing 19, the handle bulb 23 is illuminated, such that light is provided for operation of the hoop by contact with the guide 16 at twilight or at night. As further illustrated in FIG. 3, the battery housing 19 is closed opposite the switch end by a housing wall 33, which receives the grip 34, in order to handle and manipulate the guide 16 and propel the hoop 2 by contact between the hoop rim 3 of the hoop 2 and the plate bevel 39 of the telescoping handle 18.

Figure 8:
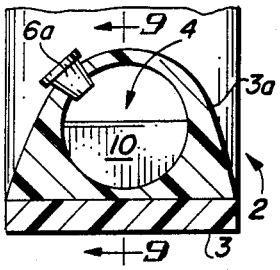
FIG. 8 is a transverse sectional view taken along line 8—8 of the hoop illustrated in FIG. 2.
Figure 9:
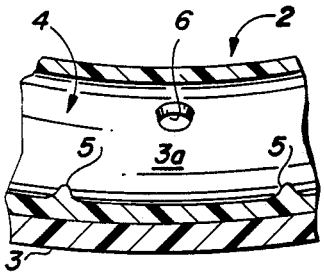
FIG. 9 is a longitudinal sectional view taken along line 9—9 of a portion of the hoop rim illustrated in FIG. 8.

Referring now to FIGS. 2, 8 and 9 of the drawings, in a most preferred embodiment of the invention the rim sleeve 3*a* of the hoop rim 3 is provided with an internal rim cavity 4 and spaced baffles 5, in order to receive supply of water 10 or other liquid through an access opening 6, which is closed by a plug 6*a*. The water 10 flows through the rim cavity 4 responsive to rotation of the hoop 2 and the reverse flow of the water 10 in the rim cavity 4 is slowed by the baffles 5, in order to slow the rotation of the hoop 2, create a lower center of gravity therein and thereby stabilize the hoop 2 during use. The forward rotation of the hoop 2 is slowed as the water initially flows upwardly through the rim cavity 4 in the direction of rotation of the hoop 2, and then back downwardly in the opposite direction over the baffles. It will be reorganized that a liquid having a different viscosity than water, including the liquid metal mercury, can be introduced into the rim sleeve 3*a* through the access opening 6 to achieve the same objective. Furthermore, the rim sleeve 3*a* may be constructed of a transparent plastic material and the liquid tinted with a desired color and/or mingled with colored flakes, beads or the like, to enhance the ornamentation of the hoop 2 as it rotates.

Figure 12:
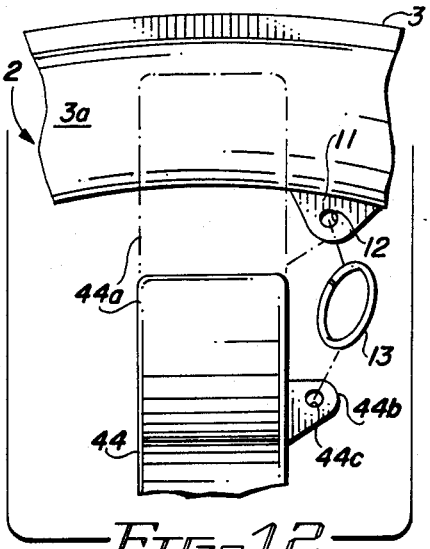
FIG. 12 is a side exploded view, partially in section, of a housing mount arm of the optional light housing and the hoop illustrated in FIG. 2.
Figure 13:
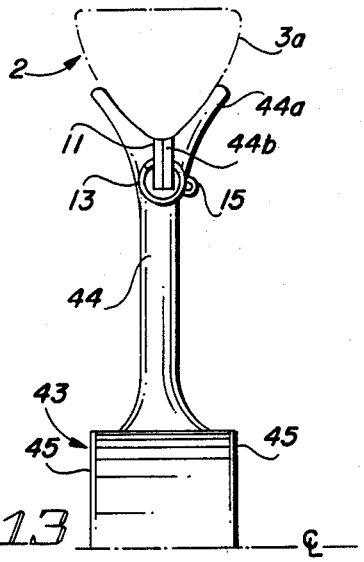
FIG. 13 is an assembled view of the housing mount arm attached to the hoop, as illustrated in FIG. 2.
Figure 10:
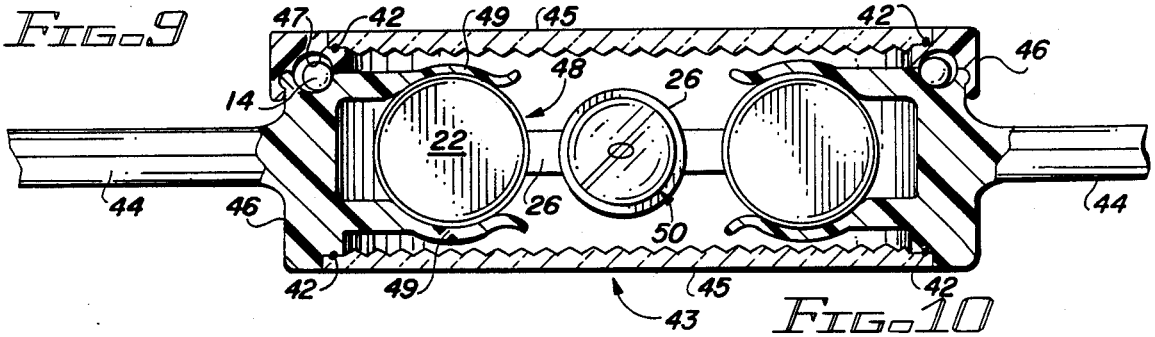
FIG. 10 is a transverse sectional view taken along line 10—10 of the optional light housing located in the hoop illustrated in FIG. 2.
Figure 11:
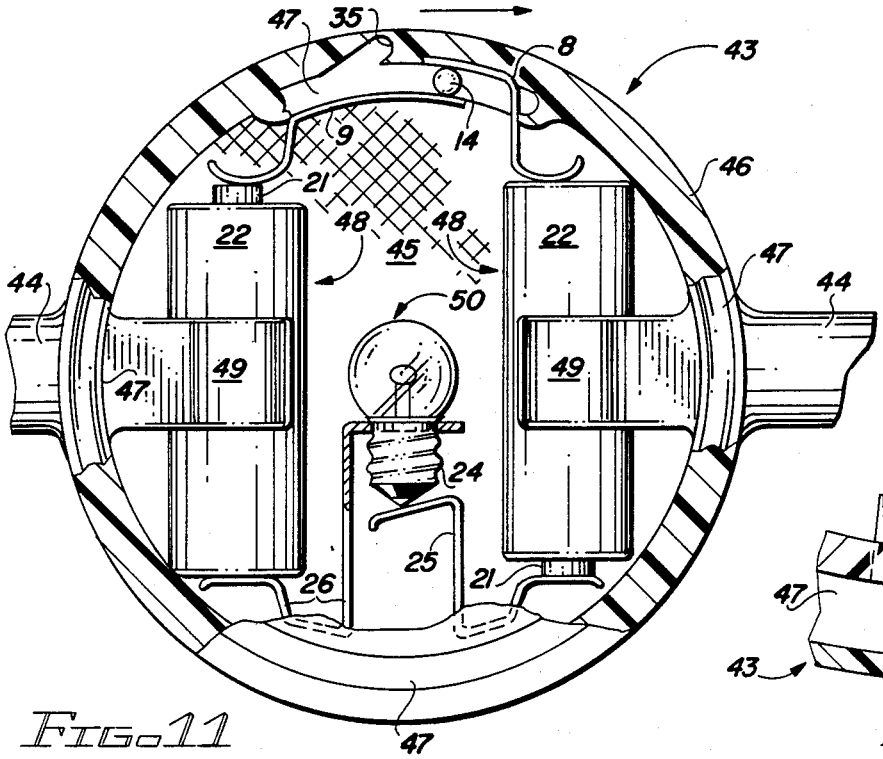
FIG. 11 is a longitudinal sectional view of the optional light housing illustrated in FIGS. 2 and 10.
Figure 14:
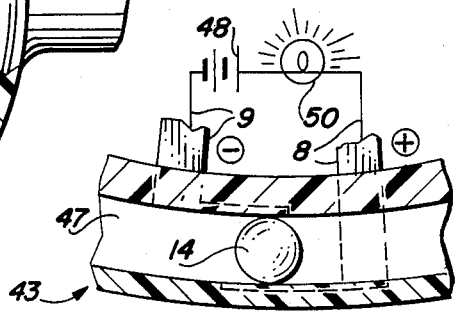
FIG. 14 is a longitudinal sectional view of a portion of the housing ring of the optional light housing, more particularly illustrating a preferred configuration for a ball race and metal ball for traversing the ball race, as well as battery contacts for illuminating a bulb located inside the light housing.

Referring now to FIGS. 10–14 of the drawings, the optional light housing 43 is mounted on the rim sleeve 3*a* of the hoop rim 3 by means of a pair of cradle brackets 44*b*, provided at the juncture of the arm cradles 44*a*, which cradle brackets 44*b* extend from the housing mount arms 44, and corresponding split ring tabs 11, provided on the rim sleeve 3*a* of the hoop rim 3, as illustrated in FIGS. 12 and 13. A split ring 13 is designed to extend through a tab opening 12 provided in the split ring tab 11 and a registering cradle bracket ring opening 44*c*, located in the cradle bracket 44*b*. When this is accomplished, the arm cradles 44*a* receive the contoured rim sleeve 3*a* of the hoop rim 3 as illustrated in FIG. 13, to securely, yet removably, mount the light housing 43 across a diameter of the hoop 2. One or more bells 15 may be attached to each of the split rings 13, as desired. In a most preferred embodiment of the invention, the housing ring 46 of the light housing 43 is hollow and includes a pair of battery clamps 49, extending inwardly of the housing mount arms 44, respectively. A housing light 50 is supported between the battery clamps 49 by one end of a bulb negative lead 26, which is located inside the light housing 43 and the opposite end of the bulb negative lead 26 engages the negative terminal of a first one of two housing batteries 48. The base 24 of the housing light 50 engages one end of a bulb positive lead 25, the opposite end of which bulb positive lead 25 seats against the positive terminal 21 of the second housing battery 48. The positive terminal 21 of the first housing battery 48 also engages a negative ball contact 9, which extends from the interior of the light housing 43 into a tubular ball race 47, having a reverse rotation trap 35, provided in the housing ring 46. The negative terminal 22 of the second battery 48 is placed in contact with one end of a positive ball contact 8, the opposite end of which positive ball contact 8 extends into the ball race 47 opposite the corresponding end of the negative ball contact 9, as further illustrated in FIGS. 11 and 14. Accordingly, referring to FIGS. 11 and 14, when the steel ball 14 traverses the tubular ball race 47 in a direction opposite to that of the direction of rotation of the hoop 2 (indicated by arrow in FIG. 11) and bridges the gap between the positive ball contact 8 and the negative ball contact 9, the reverse rotation trap 35 is by-passed by the steel ball 14, the light housing electrical circuit is periodically completed and the housing light 50 is momentarily illuminated. It will be appreciated by those skilled in the art that continued rotation of the steel ball 14 in the tubular ball race 47 periodically causes the housing light 50 to illuminate as the hoop 2 is rotatably propelled by the guide 16. The circular housing reflectors 45 are designed to be glued to the housing ring 46 by means of glue spots 42, as illustrated in FIG. 10. Pressure applied to the housing reflectors 45 easily breaks these bonds to facilitate replacement of the housing batteries 48 and the housing light 50, or the housing reflectors 45 themselves. Alternatively, the housing reflectors 45 can be designed to "snap fit" into the housing ring 46, or they may be attached to the housing ring 46 by means of suitable fasteners (not illustrated), as desired. As illustrated in FIG. 11, if it is desired to propel the hoop 2 such that the steel ball 14 does not traverse the ball race 47, the hoop 2 is propelled in the direction opposite to that indicated by the arrow, such that the steel ball 14 is trapped in the reverse rotation trap 35.

In operation, and referring again to the drawings, the hoop and guide device 1 is utilized by initially grasping the grip 34 of the receiving handle 17 of the guide 16 and extending the telescoping handle 18 to the desired length, as illustrated in FIG. 1. The plug *6a* is then removed from the access opening 6 in the rim sleeve *3a* of the hoop rim 3, as illustrated in FIGS. 8 and 9 and a quantity of water 10 or other liquid is poured through the access opening 6 into the rim cavity 4, as illustrated in FIG. 8. The plug *6a* is then replaced in the access opening 6. The hoop 2 is subsequently placed in a vertical configuration as illustrated in FIG. 2 and is rotatably propelled over suitable terrain by grasping the grip 34 in one hand and manipulating the guide 16 to periodically contact the plate bevel 39 and the contact plate 37, depending upon the irregularity of the terrain, with the hoop rim 3 of the hoop 2, as the hoop 2 rotates and traverses the ground or pavement. If the hoop and guide device 1 is used at twilight or at night, the switch 28 can be manipulated by moving the thumb contact 30 rearwardly to illuminate the handle bulb 23 and the area of contact between the contact end 36 of the guide 16 and the hoop rim 3 of the hoop 2. As the hoop 2 rotates, periodic bridging of the positive ball contact 8 and negative ball contact 9 by the steel ball 14 rolling in the tubular ball race 47, causes the housing light 50 to illuminate at an interval which is proportional to the rotational speed of the hoop 2.

Referring again to FIGS. 1 and 3–5 of the drawings, it will be appreciated that the guide batteries 20, as well as the handle bulb 23, the bulb positive lead 25 and the bulb negative lead 26, can be encased in a capsule or container (not illustrated) which is removably inserted in the hollow battery housing 19, instead of directly in the battery housing 19, as illustrated. Furthermore, it will also be appreciated by those skilled in the art that both the hoop 2 and the guide 16 elements of the hoop and guide device 1 can be constructed of a suitable plastic such as polyethylene and polypropylene, in non-exclusive particular, by injection-molding techniques or other construction methods which are well known to those skilled in the art, for enhanced safety and ease of construction. Furthermore, the battery housing 19 can be constructed sufficiently large to accommodate guide batteries 20 and handle bulbs 23 of selected size and number, depending upon the relative location of the bulb positive lead 25 and the bulb negative lead 26. Similarly, the light housing 43 can be constructed sufficiently large to accommodate one or more housing batteries 48 and housing lights 50 of selected size and number.

Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A hoop and guide device comprising a round hoop having a rim of selected diameter and width, a rim cavity provided in said rim, a plurality of baffles disclosed in said rim cavity in spaced relationship and a selected quantity of liquid located in said rim cavity, and a guide having an elongated receiving handle, an elongated telescoping handle carried by said receiving handle in telescoping relationship and contact means provided on said telescoping handle for contacting said rim and causing said hoop to roll, whereby said hoop is stabilized in rolling mode by the liquid and said baffles in said rim cavity responsive to propulsion of said hoop by said guide.

2. The hoop and guide device of claim 1 further comprising handle light means carried by said receiving handle for illuminating said contact means in the dark.

3. The hoop and guide device of claim 1 further comprising hoop light means carried by said hoop for illuminating said hoop.

4. The hoop and guide device of claim 1 further comprising:

(a) handle light means carried by said receiving handle for illuminating said contact means in the dark; and (b) hoop light means carried by said hoop for illuminating said hoop.

5. The hoop and guide device of claim 1 wherein said contact means further comprises a contact plate fitted in said telescoping handle, a pair of side flanges upward-standing from said contact plate in spaced relationship and a plate bevel terminating said contact plate for contacting said rim.

6. The hoop and guide device of claim 5 further comprising:

(a) handle light means carried by said receiving handle for illuminating said contact means in the dark; and (b) hoop light means carried by said hoop for illuminating said hoop.

7. The hoop and guide device of claim 3 wherein said hoop light means further comprises a light housing; a pair of mount arms carried by said light housing, said mount arms adapted for attachment to said rim; a tubular ball race provided in said light housing and a metal ball disposed in said ball race for traversing said ball race responsive to rolling of said hoop; housing battery leads provided in said housing; at least one battery and at least one housing bulb provided in said housing, said housing battery leads connecting said housing bulb to said battery and wherein one end of said housing battery leads extend into said ball race in spaced relationship, whereby traversal of said ball race by said ball causes said ball to periodically contact said one end of said housing battery leads and said housing bulb to illuminate.

8. The hoop and guide device of claim 3 wherein said contact means further comprises a contact plate fitted in said telescoping handle, a pair of side flanges upward-standing from said contact plate in spaced relationship and a plate bevel terminating said contact plate for contacting said rim and further comprising a handle light carried by said receiving handle for illuminating said contact means in the dark, said handle light having switch means, handle battery leads, at least one battery and a handle bulb provided in said receiving handle, with said handle bulb projecting from said receiving handle and wherein said handle battery leads connect said switch means, said battery and said handle bulb for illuminating said handle bulb responsive to manipulation of said switch means.

9. The hoop and guide device of claim 8 wherein said hoop light means further comprises a light housing; a pair of mount arms carried by said light housing, said mount arms adapted for attachment to said rim; a tubular ball race provided in said light housing and a metal ball disposed in said ball race for traversing said ball race responsive to rolling of said hoop; housing battery leads provided in said housing; at least one battery and at least one housing bulb provided in said housing, said housing battery leads connecting said housing bulb to said battery and wherein one end of said housing battery leads extend into said ball race in spaced relationship, whereby traversal of said ball race by said ball causes said ball to periodically contact said one end of said housing battery leads and said housing bulb to illuminate.

10. A hoop and guide device comprising an elongated guide and a round hoop having a rim of selected diameter and width; a hoop light housing removably carried by said hoop; a circular, tubular ball race provided in said hoop light housing and a metal ball disposed in said ball race for traversing said ball race responsive to propulsion of said hoop by said guide; a pair of housing electrical leads disposed in said hoop light housing, with one end of said housing electrical leads extending into said ball race in spaced relationship for periodically contacting said ball; at least one housing battery and a housing bulb disposed in said hoop light housing, with the opposite end of said housing electrical leads engaging the positive and negative terminals of said housing battery and said housing bulb, whereby said housing bulb is periodically illuminated responsive to traversal of said ball race and bridging of said one end of said housing electrical leads by said ball.

11. The hoop and guide device of claim 10 wherein said guide further comprises an elongated receiving handle, an elongated telescoping handle carried by said receiving handle in telescoping relationship and contact means provided on said telescoping handle for contacting said rim and causing said hoop to roll.

12. The hoop and guide device of claim 11 further comprising a handle light carried by said receiving handle for illuminating said contact means in the dark, said handle light comprising switch means, handle battery leads, at least one battery and a handle bulb provided in said receiving handle, with said handle bulb projecting from said receiving handle, a handle reflector provided on said handle for covering said handle bulb and reflecting the light from said handle bulb and wherein said handle battery leads connect said switch means, said battery and said handle bulb for illuminating said handle bulb responsive to manipulation of said switch means.

13. The hoop and guide device of claim 12 wherein said contact means further comprises a contact plate fitted in said telescoping handle, a pair of side flanges upward-standing from said contact plate in spaced relationship and a plate bevel terminating said contact plate for contacting said rim.

14. The hoop and guide means of claim 13 further comprising a reverse rotation trap provided in said tubular ball race for trapping said metal ball and preventing said metal ball from traversing said tubular ball race when said hoop is propelled in a selected direction.

* * * * *